US005371999A

United States Patent [19]

Hansen et al.

[11] Patent Number: 5,371,999

[45] Date of Patent: Dec. 13, 1994

[54] SHRINK FILM WRAPPING MACHINE

[75] Inventors: Franck E. Hansen, Grayslake; Edmund D. Brett, Mundelein; Ralph T. Howarth, Wauconda; Steven D. Levy, Glenview, all of Ill.

[73] Assignee: Inter Pak Equipment Corporation, Gurnee, Ill.

[21] Appl. No.: 135,136

[22] Filed: Oct. 12, 1993

Related U.S. Application Data

[63] Continuation of Ser. No. 15,315, Feb. 9, 1993, abandoned, which is a continuation of Ser. No. 791,659, Nov. 12, 1991, abandoned.

[51] Int. Cl.[5] ..... B65B 9/20; B65B 51/30

[52] U.S. Cl. ..... 53/450; 53/550; 53/51; 53/374.6

[58] Field of Search ..... 53/450, 51, 550, 553, 53/371.6, 374.6, 389.3

[56] References Cited

U.S. PATENT DOCUMENTS

| | | | |
|---|---|---|---|
| 3,237,371 | 3/1966 | Gerlach | 53/374.6 |
| 3,328,936 | 7/1967 | Billeb | 53/550 X |
| 3,438,173 | 4/1969 | Omori | 53/374.6 X |
| 3,473,288 | 10/1969 | Nakamura et al. | 53/550 X |
| 3,477,191 | 11/1969 | Davis et al. | 53/550 X |
| 3,524,301 | 8/1970 | Zimmerman | 53/550 X |
| 3,738,081 | 6/1973 | Heinzer | 53/550 |
| 4,520,615 | 6/1985 | Engler et al. | 53/550 |
| 4,549,386 | 10/1985 | Wilson | 53/550 X |
| 4,553,377 | 11/1985 | Klinkel | 53/374.6 X |
| 4,608,797 | 9/1986 | Shabram, Jr. et al. | 53/550 X |
| 4,870,802 | 10/1989 | Cerf | 53/550 X |

*Primary Examiner*—Horace M. Culver
*Attorney, Agent, or Firm*—Charles F. Meroni, Jr.

[57] ABSTRACT

A continuously operating machine is provided for wrapping articles with a heat shrinkable plastic film automatically and sequentially. Articles are continuously, translated along a horizontal pathway. At a first station, articles are longitudinally circumferentially tubularly overwrapped and sealed. At a next succeeding station, the so overwrapped articles are cross sealed and separated (cut). At a last succeeding station, the resulting wrapped articles are subjected to thermal film shrinking. The cross sealing and separating brings a continuously rotating heated knife and an opposed cross bar into a predetermined registration with the interspatial region between succeeding articles. The registration time duration can be regulated and increased to values substantially in excess of the momentary contact time existing in normal rotation and tangential point contact.

15 Claims, 6 Drawing Sheets

FIG. 3
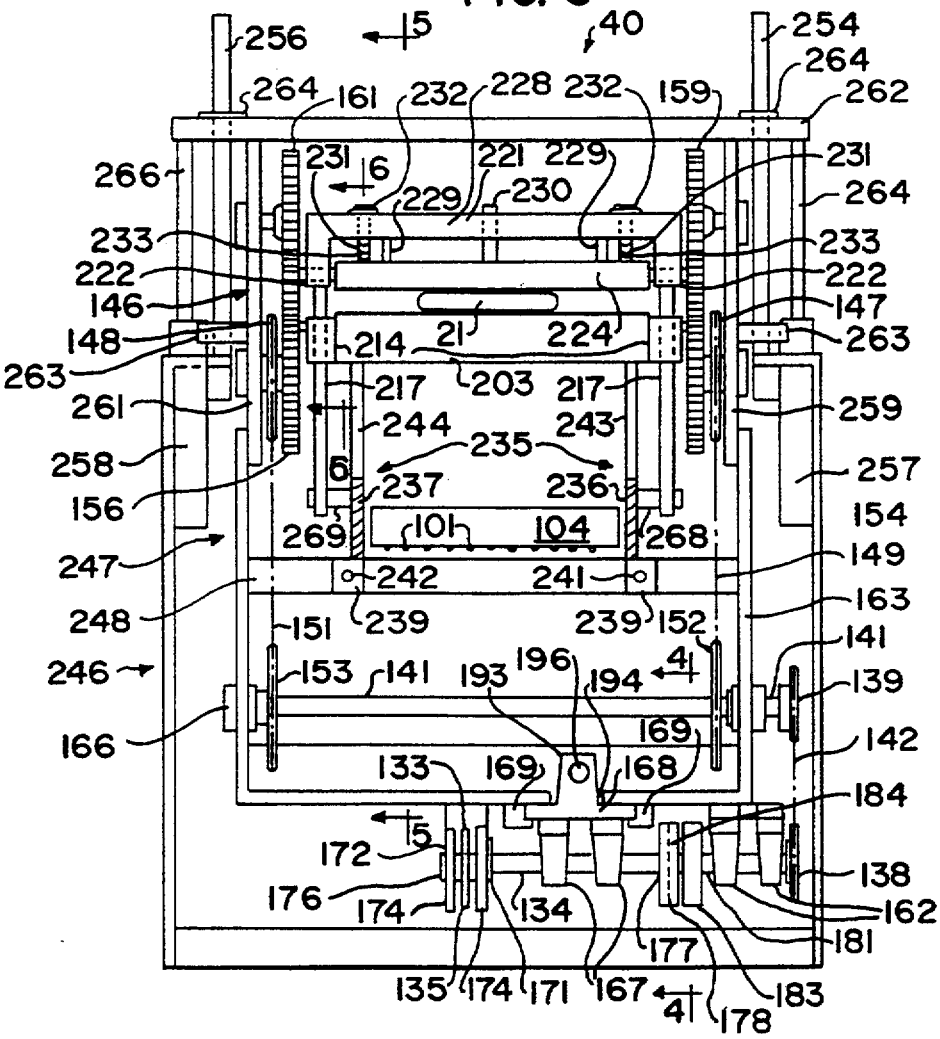
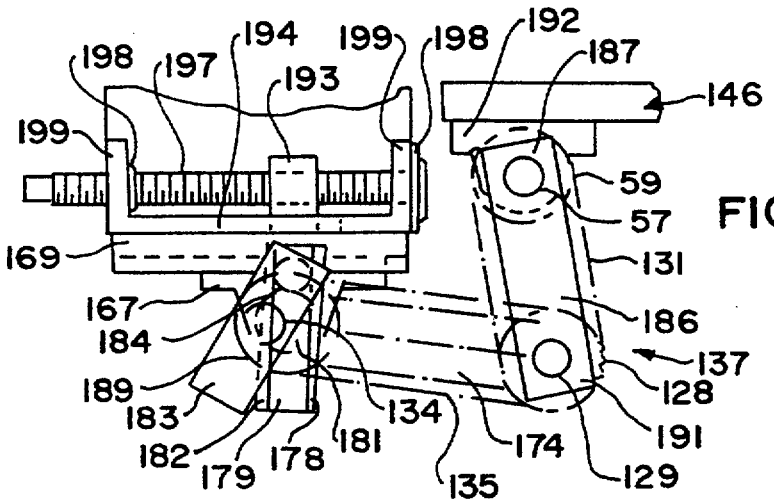
FIG. 4

SHRINK FILM WRAPPING MACHINE

This is a continuation of Ser. No. 08/015,315 filed on Feb. 9, 1993, now abandoned, which in turn is a continuation of Ser. No. 07/791,659 filed on Nov. 12, 1991, now abandoned.

FIELD OF THE INVENTION

This invention relates to an improved packaging machine, especially a continuously operating machine for wrapping articles with a heat shrinkable plastic film or the like automatically and sequentially.

BACKGROUND OF THE INVENTION

Various packaging machines for wrapping materials automatically and sequentially with heat shrinkable film are available commercially from various manufacturers. However, these machines frequently display problems in achieving synchronization between the cross head seal mechanism and the infeed conveyor, particularly when continuous operating conditions are involved. Also, the machines often require frequent and time consuming maintenance and adjustment.

Also, the prior art machines commonly involve complicated procedures and significant down time to change the machine from one operating configuration to another, such as is needed when package size is changed or different bag cut-off lengths are required. Also, prior art machines utilize specialized, costly components.

Further, operation of the prior art machines is typically carried out without means for automatic detection of malfunctioning, especially jamming in the region of the cross head seal and cut mechanism, and also prior art machines are without means for rapidly and simply clearing a cross head jam.

The art needs a new and improved wrapping machine which is adapted for use with heat shrinkable wrapping film and which has a new and improved cross head seal mechanism, which is fully synchronized, which has simplified configuration adjustments and operational features.

SUMMARY OF THE INVENTION

This invention relates to a continuously operating package wrapping machine for shrink film and the like which automatically and sequentially wraps packages sequentially with a plastic film or the like, and to methods for accomplishing the same. The machine and the method each utilize a successive combination of (a) a longitudinal circumferential package wrap and seal, (b) a transverse package seal and cut, and, when the film is heat shrinkable, (c) a shrink tunnel.

The invention provides a new and very useful continuously operating cross head seal and cut mechanism for a longitudinal sequence of longitudinally wrapped packages and to methods for continuously and sequentially transversely sealing and cutting each such longitudinally and wrapped and continuously advancing package of the package sequence. The mechanism is fully synchronizable with a continuously operating infeed conveyor system.

The invention also provides a new and very useful method for continuously accomplishing transverse sealing and cutting of wrapping film. The apparatus of this invention includes the capability for changing a wrapping machine from one operating configuration to another such as is needed when package size is changed or different bag cut-off lengths are required.

The apparatus includes a product position detector with automatic response system, and further includes a cross head jam detector, and means for rapidly and simply clearing a cross head jam using a slow reverse motion.

Advantageously, the inventive apparatus can be fabricated from components which are readily available commercially, thereby reducing manufacturing costs and minimizing maintenance costs.

The apparatus and method of the invention can be practiced at surprisingly high package unit operating rates.

Other and further aspects, objects, aims, features, advantages, applications, variations, embodiments, and the like will be apparent to those skilled in the art from the present specification taken with the accompanying drawings and appended claims.

BRIEF DESCRIPTION OF THE DRAWINGS

FIG. 3 is a transverse sectional detailed view through the cross head seal and cut assembly taken along the line III—III of FIG. 1, some parts thereof being broken away and some parts thereof being shown in section;

FIG. 4 is an enlarged fragmentary vertical longitudinal sectional detail view taken along the line IV—IV of FIG. 3;

DETAILED DESCRIPTION

Figure 1:
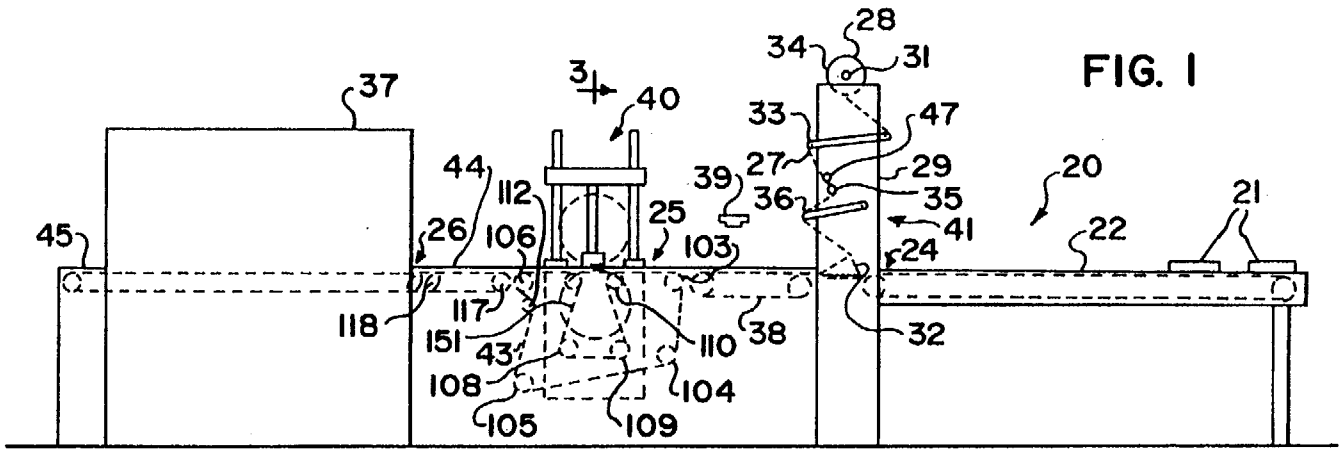
FIG. 1 a partial diagrammatic side elevational view of one embodiment of a shrink film wrapping apparatus of this invention.

Referring to FIG. 1, there is seen in side elevation a diagrammatic view of one embodiment of a shrink film wrapping machine of the present invention which is herein designated in its entirety by the numeral 20.

In machine 20, packages, articles or objects 21 that are being wrapped continuously and sequentially are moved horizontally along a conveyor pathway which extends through three successive stationary processing stations 24, 25 and 26. Thus, a plurality of similarly sized objects 21 which are to be individually wrapped by machine 20 with a heat shrinkable film 27 are sequentially deposited upon The input end of a flighted infeed endless conveyor 22 (not detailed). Conveyor 22 is preferably of the conventional chain type and is continuously operating and advancing to the left in FIG. 1 to a first processing station 24 where conveyor 22 transfers objects 21 into station 24.

First processing station 24 is provided with a continuously operating subassembly mechanism 41 for longitudinally and continuously overwrapping successive objects 21 with a film 27 and for sealing film overlapping edge regions together after formation of an overwrap having a tubular configuration. The tube center region or longitudinal axis preferably lies approximately along the longitudinal axis of the objects 21 as they are continuously translated along the path of travel. Thus, as each object 21 continuously moves through station 24, it becomes circumferentially transversely wrapped around its longitudinally extending (relative to the direction of travel) opposed side and opposed bottom and top surface portions. The film 27 is preferably comprised of a thermally shrinkable polymeric material.

At station 24, the film 27 is, in the embodiment shown, loaded in roll form 28 onto a shaft or arbor 31 at the top of an unwind stand 29. Shaft 31 rides on pairs of ball bearings (now shown). Film 27 is continuously advanced downwardly from its roll 28 and is passed through a conventional tunnel-style winged film forming plow 32 which continuously curves and wraps the film 27 circumferentially and longitudinally around each object 21 as it passes through the winged forming plow 32. The resulting wrap is in a tubular form wherein film side edges are in overlapping engagement with each other upon a longitudinally extending bottom central region of each object 21.

Preferably, in unwind stand 29, as film 27 advances from roll 28 to plow 32, it passes successively through conventional lateral roll adjustment means (not shown), one set of oscillating dancer rolls 33, a conventional tension brake (not shown), and a driven film advance friction roller 35. The film tension brake (not shown) is preferably a weighted friction strap that extends over the film roll 28. The friction roller 35 is located after the arm of the dancer rolls 33, and roller 35 is associated preferably with an adjustable nip roll 47 as film 27 is pulled from roll 28. Conveniently located between the oscillating dancer rolls 33 and the location 34 of the tension brake, the film 27 preferably passes over a roll 36 (not detailed) equipped with perforation means which perforates the film 27 in a systematic manner so that air is allowed to escape through film 27 from each wrapped and sealed object 21 as the film 27 that is wrapped and sealed thereabout undergoes thermal shrinking in a heated tunnel 37 that is located at station 26. Roll 36 also serves as a final roll which is adjustable to match each size of winged forming plow 32 used. Plow 32 sizes can be changed to accommodate different packaging requirements.

In station 24, the film opposite side edges in the formed longitudinally extending film overlapping or overlay area are secured together. For example, to accomplish securing, the film 27 in the overlay area can be charged with static electricity, or the layers of film 27 in the overlay area can be conventionally thermally interfacially bonded together so as to hold the overlapped edges of the formed film tube structure closed and together.

As each thus longitudinally tubularly wrapped object 21 leaves station 24, it enters upon the flattened upper portions of a continuously advancing conventional type of vacuumized endless belt conveyor 38. For example and preferably, belt conveyor 38 is provided with a plurality of closely spaced apertures (not detailed) that extend therethrough. As the belt conveyor 38 translates, its upper portions pass over and rest upon a grill (not detailed) or the like which overlies an upwardly opening chamber 271 within which subatmospheric pressure is maintained. Thus, the successive continuously longitudinally wrapped objects 21 are held in fixed positions relative to one another upon upper portions of belt conveyor 38, as desired. Also, the vacuum provides the force to pull and move the so wrapped objects 27 through and forwardly from station 24.

Suitable subatmospheric pressures for the upper portions of conveyor 38 are conveniently achieved by means of a venturi type vacuum pump (not shown) or the like. Preferably the venturi vacuum pump is comprised of a series of venturies with one being connected to the next (except for the first and the last in the series). Compressed air (from a convenient source, not shown) is introduced at one end of the series and is exhausted at the other end. A subatmospheric pressure for vacuum is created around each venturi and is connected to the upwardly opening chamber 271 under the conveyor 38. Compressed air volume and pressure is conveniently controlled by an electric valve (not shown) and manual bottom (not shown). A rotary type pump could also be used, if desired.

Forwardly of station 24 and before station 25, the belt conveyor 38 is preferably associated with a detector 39 which senses that each tubularly wrapped object 21 is present and properly positioned on belt conveyor 38 before that object 21 reaches station 25. Although various conventional types of detectors are suitable, it is presently preferred that detector 39 be of the adjustable infrared type. Thus, such a detector 39 emits a beam of infrared light of predetermined cross-sectional size, such as about 0.0625 inch or the like, which beam is adapted to pass through film 27 without interruption but which is adapted to be interrupted, by the presence of an object 21. If no object 21 is detected for a predetermined object 21 position on belt conveyor 38, then the machine 20 stops its cycle of operation. However, if an object 21 is detected at the predetermined position, then operation of machine 20 continues without interruption.

Figure 9:
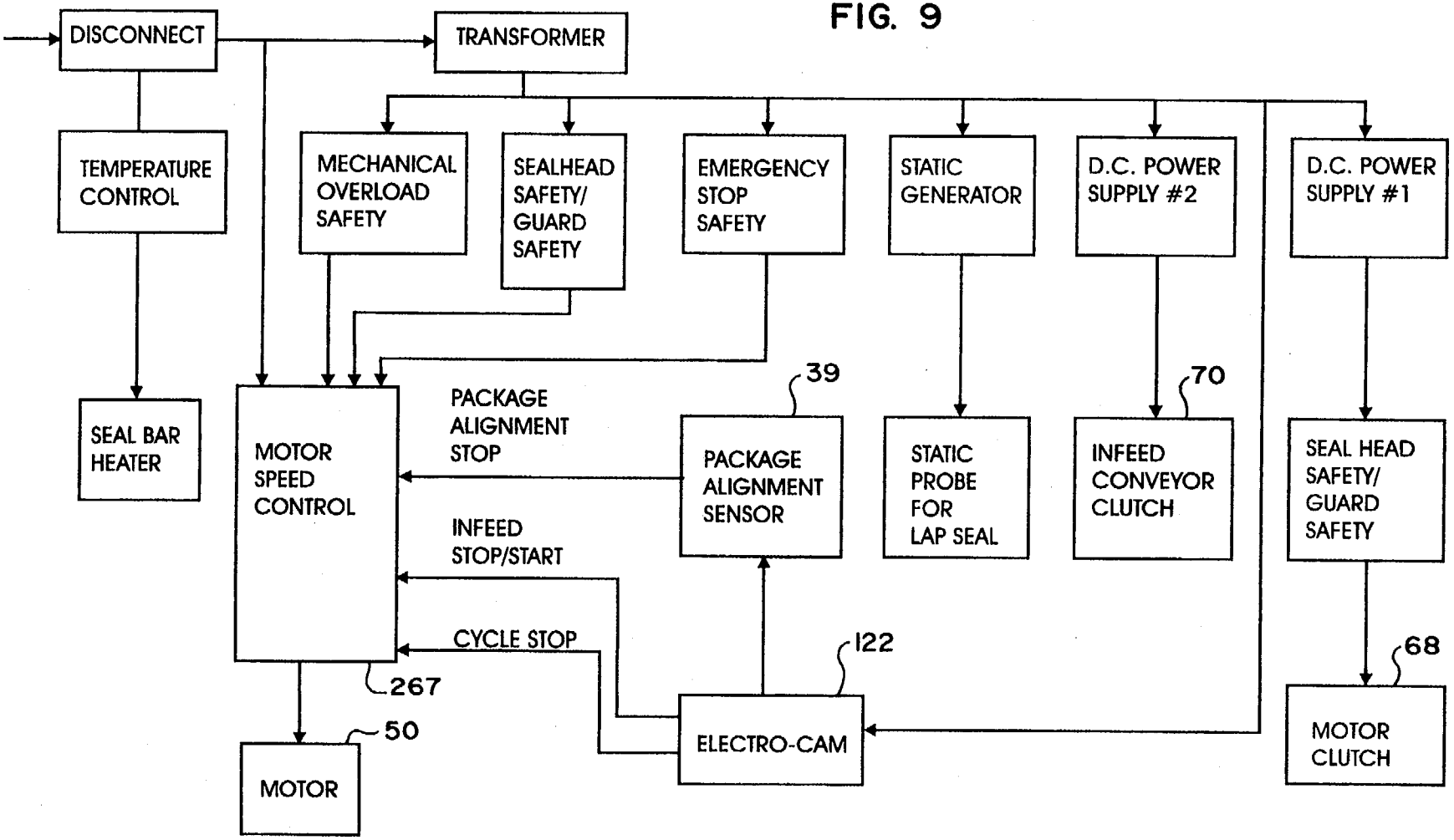
FIG. 9 is a simplified block diagrammatic view of the electrical system employed in the embodiment of FIG. 1.

A detector 39 is associated with and conveniently timed by a conventional rotary electric cam switch 122 (see FIG. 9), such as is available commercially under the trade mark "Electro Cam" from the Electro Cam Company, to accomplish such a checking for obstructions at predetermined positions on conveyor 38 in the machine 20 cycle. Specifically, and for example, when cam switch 122 is adjusted to provide one "window" per 360° of switch operating cycle, and when detector 39 operates during the time when the "window" is aligned with a predetermined area on the conveyor 38 where an object 21 is to be normally positioned; then, if the detector 39 does not sense the trailing edge of an object 21, that object 21 is in proper orientation and has advanced sufficiently toward the station 25. However, if the trailing edge is sensed, then the infrared detector beam is interrupted and the cycle stop is initiated and continued.

In place of an infrared detector, one can, if desired, employ microswitches as the detector, and those switches would function in an identical manner.

In a presently more preferred detector arrangement, the vacuumized infrared belt conveyor 38 is provided with an electric clutch (not detailed) in its drive system. This clutch drives a freewheeling sprocket combination (not shown) for powering conveyor 38 at a slightly higher speed ratio than the originally selected drive chain ratio, an overspeed of about 4 to 5% presently being preferred and illustrative. An electric eye or photo-electric sensor (not shown) is associated with belt conveyor 38, and the film 27 is provided with preprinted longitudinally spaced so called eyemarks thereon which are sensable by the photoelectric sensor. By this arrangement, the wrapping bag length about an individual object 21 can also be controlled. Thus, since the distance between eyemarks on the film 27 is always negatively toleranced, and since the error in bag length introduced is always decreasing, the overspeed drive is used to make up this difference. The rotary electric cam timing switch 122 is used to measure each preprinted mark position on the film 27 in relation to the machine 20 timing. When a mark position is detected to be out of range, the rotary electric cam timing switch 122 deactivates the clutched overspeed drive and switches the drive from on to off.

From the forward end of the upper surface of belt conveyor 38, each object 21 is transferred from belt conveyor 38 to a conveyor 43 which commences in adjacent, longitudinally spaced relationship to belt conveyor 38. Conveyor 42 moves objects 21 continuously through station 25 wherein a cross head sealer and cutter subassembly mechanism 40 operates continuously.

In cross head 40 operation, first the forward end of the bag surrounding each object 21 is cut and heat fused. Then, as each resulting individual object 21 continues its advance on the belt conveyor 43, the rearward or trailing end of each such bag is cut and heat fused, thereby completing formation of a packaging bag about each object 21. The cutting and heat fusing preferably takes place along a line which extends transversely across the direction of travel of the belt conveyor 43 and is mid-way between each pair of successive longitudinally spaced objects 21 on the belt conveyor 43. Preferably also, this line is mid-way between the top and the bottom ends of each pair of the longitudinally spaced successive objects 21.

Such a preferred spatial location for this seal and cut line is achieved for individual objects 21 by settings of machine 20 adjustments which, in accord with a particular feature of this invention, are relatively simply and quickly accomplished. Also, adjustments in synchronization and in timing of infeed conveyors relative to cross head 40 operation are similarly readily accomplished.

From station 25 and belt conveyor 43, each now completely bagged object 21 is continuously advanced successively and is transferred to an endless belt off-feed transfer conveyor 44 which is in longitudinally spaced but adjacent relationship with belt conveyor 43. Conveyor 44 in embodiment 20 is a linking conveyor which functions to deliver wrapped and sealed objects 21 to the station 26 where a continuously operating shrink tunnel 37 is situated. In an alternative arrangement, a single conveyor can be used to translate bagged objects 21 from station 25 to and through station 26, if desired. The shrink tunnel 37 is conveniently a conventional, commercially available subassembly that is equipped with a conveyor 45 and has its own control system (not shown). The respective upper surface portions of each of conveyor 45, conveyor 44, conveyor 43, conveyor 38 and conveyor 22 all are preferably substantially coplanar with respect to one another with minimal longitudinal spacing between longitudinally adjacent respective conveyors.

As shown for machine 20 in FIG. 1, on conveyor 44 each bagged object 21 is successively advanced to station 26 and heat shrink tunnel 37 and there it is transferred to a shrink tunnel associated conveyor 45. The tunnel 37 is adjusted so that the temperature profile along the pathway of belt conveyor 45 therethrough provides the desired extent of thermal shrinkage for each bag about its associated object 21. Thus, each object 21 emerging from tunnel 37 is completely packaged with a heat shrunk and sealed film. Packaged objects 21 at the horizontal terminus of belt conveyor 45 are collected for storage, subsequent further bulk packaging, shipment, or the like, as desired.

Figure 8:
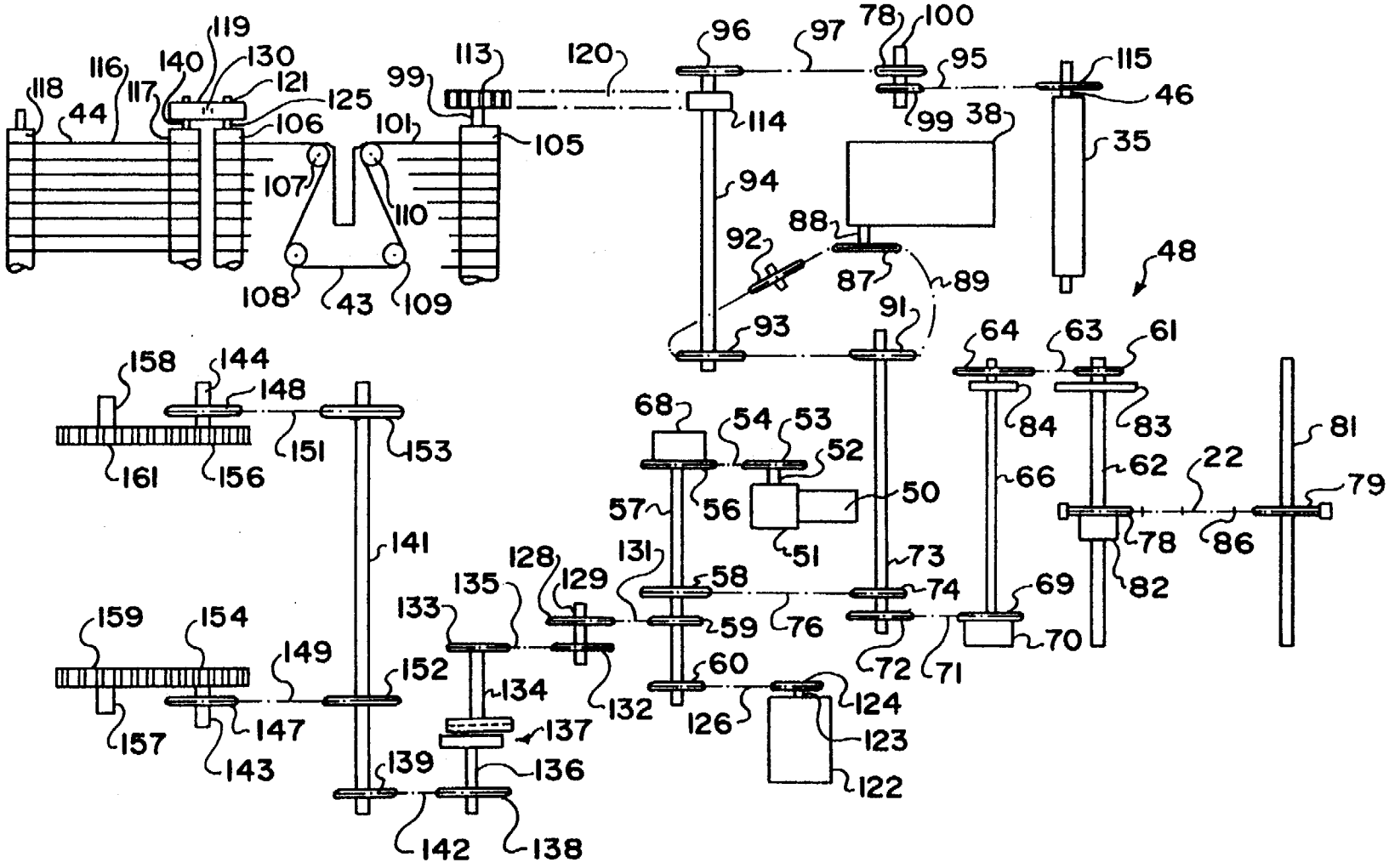
FIG. 8 is a simplified diagrammatic view illustrating the manner in which rotational drive energy is transferred from a single motor drive to the individual driven components of the embodiment of FIG. 1.

The machine 20 incorporates a drive subsystem 48 which causes the conveyors 22, 38, 43 and 44, the film wrapper and longitudinal sealer 30 at station 24, and the cross head sealer and cutter 40 at station 25 to operate synchronously with each other. The drive subsystem 48 is illustrated, for example, in FIGS. 2 and 8. In these Figures, all the non-drive elements of machine 20 are removed. Each drive transfer member is conveniently a roller chain, a gear belt, a rubberized timing belt, or the like. FIG. 8 is purely diagrammatic. Alternative arrangements for accomplishing power transfer and control of machine subcomponents could be used if desired.

Figure 2:
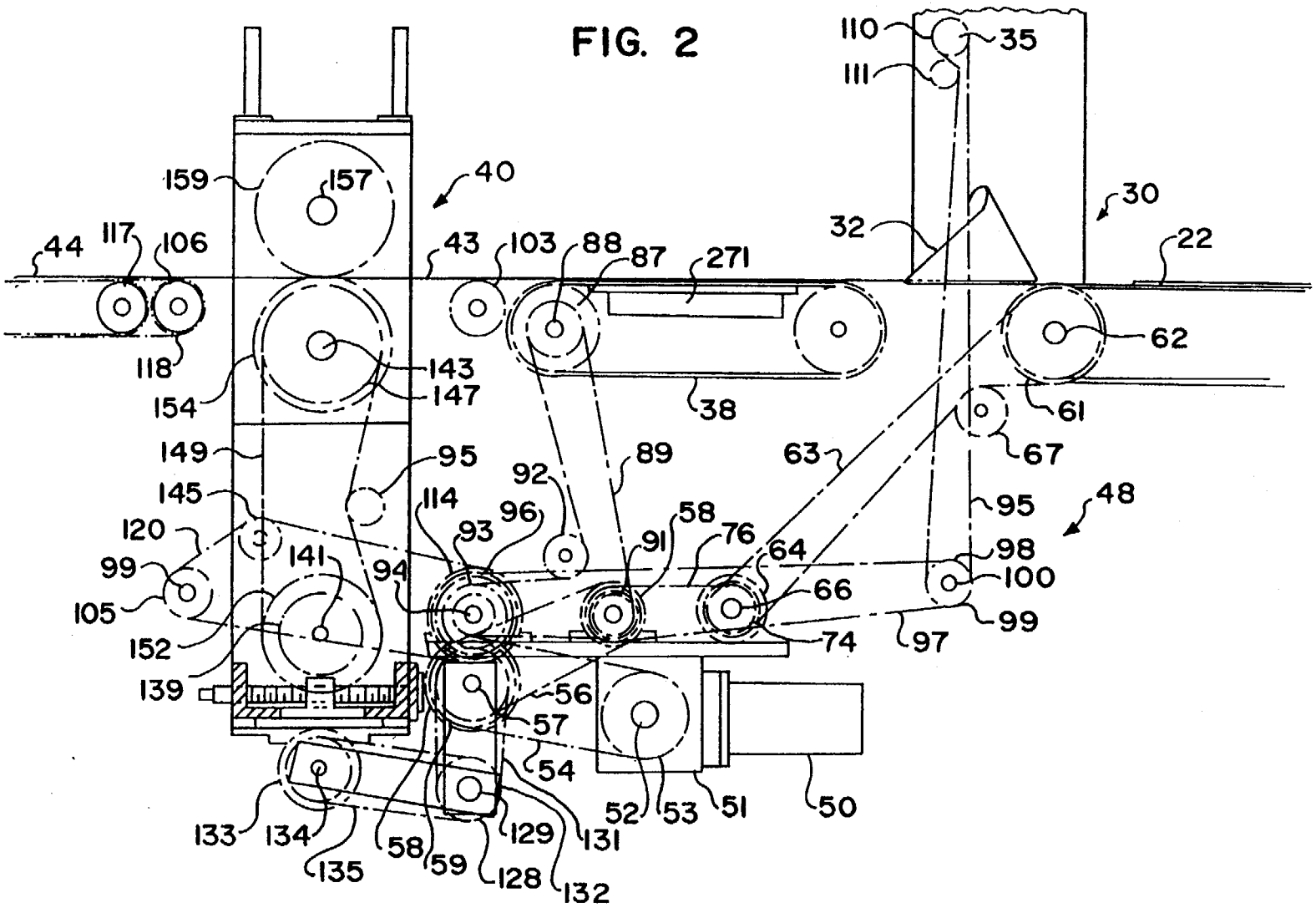
FIG. 2 is a diagrammatic view in side elevation of the drive assembly utilized in the apparatus embodiment of FIG. 1.

Referring to FIGS. 2 and 8, a single drive motor 50 is directly associated with a conventional gear box 51 whose output stub drive shaft 52 is associated with a drive sprocket 53. A roller chain 54 interconnects drive sprocket 53 with a sprocket 56 that is itself mounted on driven power transfer shaft 57. Shaft 57 is further associated with mounted sprockets 58, 59 and 60. Shaft 57 is also associated with an electric clutch 68.

To translate conveyor 22, a sprocket 61 that is associated with conveyor end shaft 62 of conveyor 22 is driven by a roller chain 63 that is also associated with a sprocket 64 which is mounted on shaft 66. Tension on roller chain 63 is maintained by means of an idler sprocket 67 (not shown in FIG. 8, but see FIG. 2).

Another sprocket 69 that is mounted on shaft 66 rotatably drives shaft 66 by a roller chain 71 which is itself driven by its association with a sprocket 72 that is mounted on an adjacent shaft 73. A sprocket 74 that is mounted on a shaft 73 is driven and consequently rotatably drives the 73, the sprocket 74 itself being engaged with a roller chain member 76 that is associated with the sprocket 58 which is mounted on shaft 57. Thus, power is transferred from motor 50 to drive conveyor 22.

The infeed conveyor 22 is provided with an electric clutch 70 that is associated with shaft 66, and the flighted chain of conveyor 22 is translatably driven through a driven sprocket 78 that is mounted on a conveyor 22 end shaft 62 and an idler sprocket 79 that is mounted on a conveyor 22 opposite end shaft 81. Sprocket 78 is preferably equipped with a torque limiter or slip clutch 82. In adjacent relationship to sprockets 61 and 64, the respective shafts 62 and 66 are additionally provided with standby sprockets, such as sprockets 83 and 84, respectively. The latter sprockets provide an appropriate drive for an alternative positioning for the roller chain member 63 so that the flight centers 86 that are associated with the flight chain conveyor 22 can be changed in longitudinal spacing relative to one another when the operational mode of machine 20 is changed for use in packaging with objects 21 of a different length relative to an initial object length.

To translate vacuumized conveyor 38, a sprocket 87 that is associated with conveyor end shaft 88 of conveyor 38 is driven by a roller chain 89 that is also associated with a sprocket 91 that is mounted on shaft 73. The driving of shaft 73 through sprocket 58 and roller chain 76 is as above described. Thus, power is transferred from motor 50 to the drive conveyor 38.

The travel path of roller chain 89 also includes association with an idler sprocket 92 and with a drive sprocket 93 mounted on shaft 94. The shaft 94, in turn, rotates a sprocket 96 that is mounted thereon. The sprocket 96 drives a roller chain 97 that is engaged with a jacket sprocket 98 that is mounted on a jack shaft 100. Another pack sprocket 99 that is also mounted on jack shaft 100 is engaged with a roller chain 95 that drives a sprocket 115 which is mounted on a shaft 46. The shaft 46 mounts roller 35 (which draws film from roller 28). Tension on roller chain 95 is conveniently maintained by means of an idler sprocket 111 (not shown in FIG. 8, but see FIG. 2) in the tower of film wrapper and longitudinal sealer 30.

Figure 5:
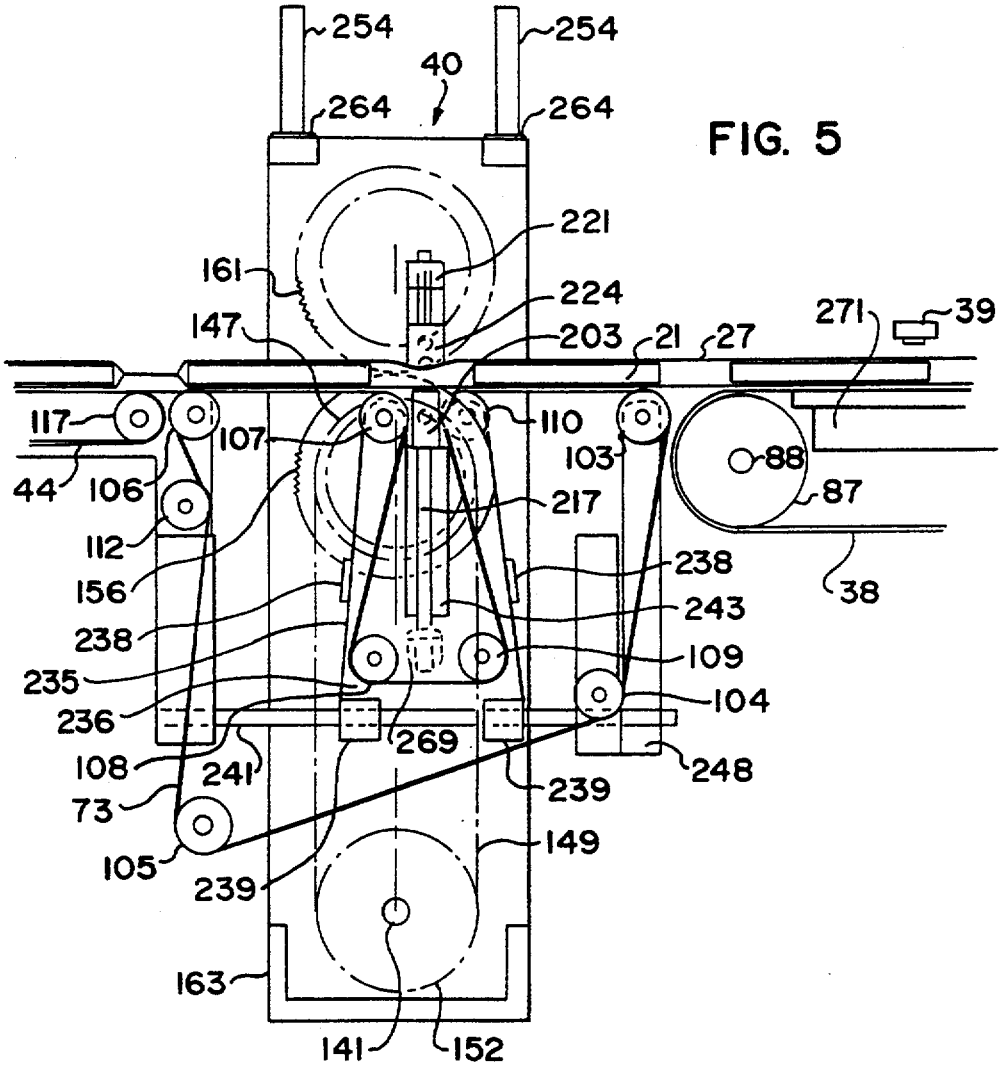
FIG. 5 is an enlarged vertical longitudinal sectional view through the cross head seal and cut assembly taken along the line V—V of FIG. 3, some parts thereof being broken away and some parts thereof being shown fragmentarily.

The conveyor 43 is conveniently comprised of a plurality of transversely spaced, longitudinally parallel endless belt-like members 101 which are preferably each slightly elastomeric (conventional structure not detailed). These members 101 are each individually received in a respective one of a plurality of longitudinally (relative to each roller) preferably equally spaced grooves 102 on each guidance roller, such as illustratively shown in guide roller 105 in FIG. 8. The pathway of conveyor 43 is defined by the transversely extending positioning of each one of a plurality of such guide rollers which are identified by the respective numerals 103, 104, 105, 106, 107, 108, 109 and 110 (see, for example, FIG. 5). Tension on conveyor 43 is conveniently maintained by the length of the belt-like members 101, but conveyor 43 incorporates an idler guidance roller 112.

The off-feed conveyor 44, like conveyor 43, also preferably comprises a plurality of transversely spaced, longitudinally parallel endless cable-like members 116 which are similar in structure to members 101 provided with an elastomeric surface layer (not detailed). These members 116 are each received in a respective one of a plurality of longitudinally (relative to the roller) preferably equally spaced grooves (not detailed) on each of the guidance rollers which here comprise a pair of spaced, parallel rollers 117 and 118 over circumferential portions of which the members 116 are mounted. The pathway of off-feed conveyor 44 is thus inclusive of an upper portion and a lower portion. Guide roller 117 extends in spaced, transverse, adjacent, parallel relationship to guide roller 106.

As shown, for example, in FIG. 8, to translatably move conveyor 43, guide roller 105 thereof has mounted on the shaft 99 thereof a sprocket 113 which is normally continuously engaged with another sprocket 114 which is mounted on the shaft 94 by means of a timing belt 120. Tension on belt 120 is maintained by means of an idler sprocket 145 (see FIG. 2). Thus, sprocket 114 drives sprocket 113 and power is transferred via shaft 94 from motor 50 to drive the conveyor 43. Movements of conveyer 43 are further described below.

To translatably move outfeed conveyor 44, guide roller 106 has mounted on the shaft 125 thereof a sprocket 121 which is normally continuously engaged through a timing belt 130 connecting with another sprocket 119 which is mounted on the shaft 140 of guide roller 117. Thus, sprocket 121 drives sprocket 119 and power is transferred via shaft 125 from motor 50 to drive the conveyor 44.

To associate rotary electric cam switch 122 with motor 50 and achieve controlled stop of machine 20 in accord with output from cam switch 122, the input shaft 123 of cam switch 122 has mounted thereon a sprocket 124 (see FIG. 8). A roller chain member 126 engages sprocket 124 with a sprocket 60 that is mounted on driven shaft 57. Thus, cam switch 122 can be programmed for cooperative operation with detector 39, as described above. In addition, cam switch 122 can be used to regulate start/stop of infeed conveyor 22 and to regulate start/stop of a machine 20 operating cycle (see FIG. 9).

To transfer power to cross head sealer and cutter 40, the sprocket 59 on shaft 57 is utilized to drive a first sprocket 128 that is mounted on transfer shaft 129 by means of an interconnecting roller chain 131. Then, a second sprocket 132 that is also mounted on transfer shaft 129 is utilized to drive a sprocket 133 that is mounted on delivery shaft 134 through an interconnecting roller chain 135. Rotational power is transferred from delivery shaft 134 to receiving shaft 136 through a pause cam subassembly 137 (whose structure is hereinafter described). The receiving shaft 136 has mounted thereon a sprocket 138 that is utilized to transfer power to a sprocket 139 that is mounted on a cross shaft 141 by means of an interconnecting roller chain 142. Thus, rotation of shaft 136 causes rotation of shaft 141.

Rotatably mounted in fixed coaxial but axially spaced relationship to one another is a first pair of stub shafts 143 and 144, each shaft 143 and 144 being journaled on a different opposed side of the cross head 40 using the frame assembly 146 of cross head 40 for support. Each stub shaft 143 and 144 is in generally vertically spaced, parallel relationship to cross shaft 141, and each stub shaft 143 and 144 has mounted thereon a sprocket 147 and 148, respectively. Each sprocket 147 and 148 is rotatably driven by a roller chain 149 and 151, respectively. Each roller chain 149 and 151 is engaged also with a respective one of a pair of aligned coplanar driving sprockets 152 and 153 which are both mounted on cross shaft 141. Tension on each respective roller chain 149, 151 is conveniently regulated by an associated sprocket 95 (paired, see FIG. 2). Mounted in opposed relationship to one another adjacent the inner end of each stub shaft 143 and 144 is a respective one of a pair of drive gears 154 and 156, respectively.

Rotatably mounted in fixed coaxial but axially spaced relationship to one another is a second pair of stub shafts 157 and 158, each shaft 157 and 158 being journaled on a different side of the cross head 40 using the cross head frame assembly 146. Each stub shaft 157 and 158 is in vertically equally spaced, parallel relationship to the adjacent respective one of the stub shafts 143 and 144. Mounted in opposed relationship to one another adjacent the inner end of each stub shaft 157 and 158 is one of a pair of driven gears 159 and 161, respectively. Each of driven gears 159 and 161 is in engaged relationship with its adjacent drive gear 154 and 156, respectively. The interrelationship between the gears 159 and 154 and the gears 161 and 156 is such that all of shafts 143 and 157. and 144 and 158, respectively, rotate at the same speed (or rpm). Thus, power is transferred to cross head sealer and cutter 40 from motor 50.

The operation and functional effect of the pause cam subassembly 137 is readily understood by reference to FIGS. 3 and 4. The shaft 136 is supported and journaled by a pair of bearing pillow blocks 162 which are both fixedly held and supported in coaxial aligned relationship to each other at a bottom corner portion of the U-configured carriage member 163 of frame assembly 146 of cross head 40. Shaft 141 is rotatably journaled at its respective opposite ends by bearings 164 and 166 (see FIG. 3) in respective opposed side portions of U-configured carriage member 163 and is in generally vertically spaced, parallel relationship to shaft 136. Sprockets 138 (on shaft 136) and 139 (on shaft 141) are in vertically spaced, coplanar relationship for mutual engagement with common roller chain 142.

The shaft 134 is supported and journaled by a pair of pillow blocks 167 which are both fixedly held and supported in coaxial aligned relationship to each other by a platform slide 168. A pair of opposed supporting guides 169 are provided. The base of each guide 169 is mounted to a bottom facial portion of the U-configured carriage member 163 so that each guide 169 is in transversely spaced relationship relative to the other thereof and so that together the guides 169 are adapted to hold slidably the slide 168 so that shaft 134 as held by pillow blocks 167 is in end adjacent, parallel relationship relative to the shaft 136 with a coaxial relationship between shafts 134 and 136 being achieved at one position of slide 168. Thus, longitudinal reciprocal sliding movements of slide 168 within the guides 169 cause movement of shaft 134 into and away from coaxial alignment with shaft 136.

The end region 176 of shaft 134 has mounted thereon the sprocket 133. On each side of sprocket 133 on shaft 134 one end of a lever arm pair 174 is journaled by a bearing 171 (paired). The relationship between shaft 134 and its associated components is such that, for example, shaft 134 can be laterally displaced from a position that is coaxial with shaft 136 without appreciable coaxial (relative to shaft 134) displacement of shaft 134 in either of its longitudinal directions. The result is that shaft 134 can be axially offset relative to shaft 136 with shafts 134 and 136 being parallel to one another.

The opposite end region 177 of shaft 134 has mounted thereon a rectangular plate 178 which has an elongated shallow cavity 179 formed therein. The cavity 179 extends radially outwardly and is diametrically perpendicular relative to the axis of shaft 134. Cavity 179 is axially open forwardly towards the adjacent end region 181 of shaft 136. Cavity 179 has along each of its longitudinal sides a forwardly extending shoulder 182.

The adjacent end region 181 of shaft 136 has mounted thereon a rectangular plate 183 which has a diametrically extending flattened forward end face, and a post or cam follower 184 projects axially forwardly therefrom (relative to the axis of shaft 136) in radially spaced relationship to the axis of shaft 136.

When the shafts 134 and 136 are in their assembled configuration as shown, for example, in FIG. 3, the forward region of cam follower 184 on plate 183 is received in cavity 179 and thus is engaged with plate 178. Thus, when shaft 134 is coaxial with shaft 136, the shaft 136 turns uniformly with the shaft 134 at the same constant rotational speed as that at which the shaft 134 is rotatably driven. However, when the end 177 of shaft 134 is radially displaced from such coaxial configuration by slidably moving slide 168 along the guides 169, then the speed of rotation of shaft 136 during each revolution thereof varies even though the speed of rotation of shaft 134 remains constant. Such rotational speed variation of shaft 136 is caused by the fact that the post 184 moves in an eccentric manner about the axis of the shaft 134. When, compared to the coaxial configuration, the radial distance of the post 184 relative to the axis of shaft 134 is shortened, then shaft 136 turns at a slower speed (instantaneous rpm) than the instantaneous rpm of shaft 134 (which is substantially constant). On the other hand, when this radial distance from shaft 134 axis to path of the past 184 is lengthened, then shaft 136 turns at a higher speed (instantaneous rpm) than the instantaneous rpm of shaft 134. Hence, this arrangement of shafts 134 and 136, their respective plates 178 and 183, and their associated components, provides in combination a capacity for varying the speed of shaft 136 during each revolution thereof relative to shaft 134. This eccentric linkage arrangement is termed a pause cam herein.

For purposes of regulating the position of the slide 168 (and the position of shaft 134), the slide 168 has fixed thereto an upstanding projection 193 that extends through a transversely extending elongated slot 194 which is formed in the bottom of the U-configured carriage member 163. Projection 193 has a transversely extending threaded tap hole 196 formed therein which is threadably received around elongated screw member 197 which extends longitudinally (relative to machine 20) across the upper face of the bottom of the U-configured carriage member 163. Respective opposite end regions of screw member 197 are journaled for screw member 197 rotational movements by bearings 198 (paired) that are associated with respective support posts 199 that upstand from association with opposite edges such bottom. Thus, screw member 197 holds slide 168 and turning of screw member 197 adjusts the position of shaft 134 (and its associated components) relative to shaft 136 as desired.

To overcome the potential problem of distance change between axes of coplanar sprockets associated with roller chains in the region of shaft 134 (which would, for example, interfere with and even prevent power transfer when the shaft 134 is offset relative to shaft 136), two pairs of pivotably joined pivoting arms 186 and 174 are provided for pause cam assembly 137. Thus, one end 187 of each arm pair 186 is pivotably connected to shaft 57 whose rotational axis is fixed by pillow block 192 or the like to frame 146.

The opposite end 188 of each arm 186 is rotatably connected to shaft 129 and also is pivotably connected to one end 191 of each arm 174. The other end 189 of each arm 174 is rotatably connected to shaft 134, as above described. Thus, arms 186 maintain a fixed distance between sprocket 59 mounted on shaft 57 and sprocket 128 mounted on shaft 129 when such are interconnected by a roller chain 131, and arms 174 maintain a fixed distance between sprocket 132 mounted on shaft 129 and sprocket 133 mounted on shaft 134 when such are interconnected by a roller chain 135, even when the spatial location of the shafts 129 and 134 is changed when the slide 168 is transversely moved causing shaft 134 to be moved (translated).

Figure 7:
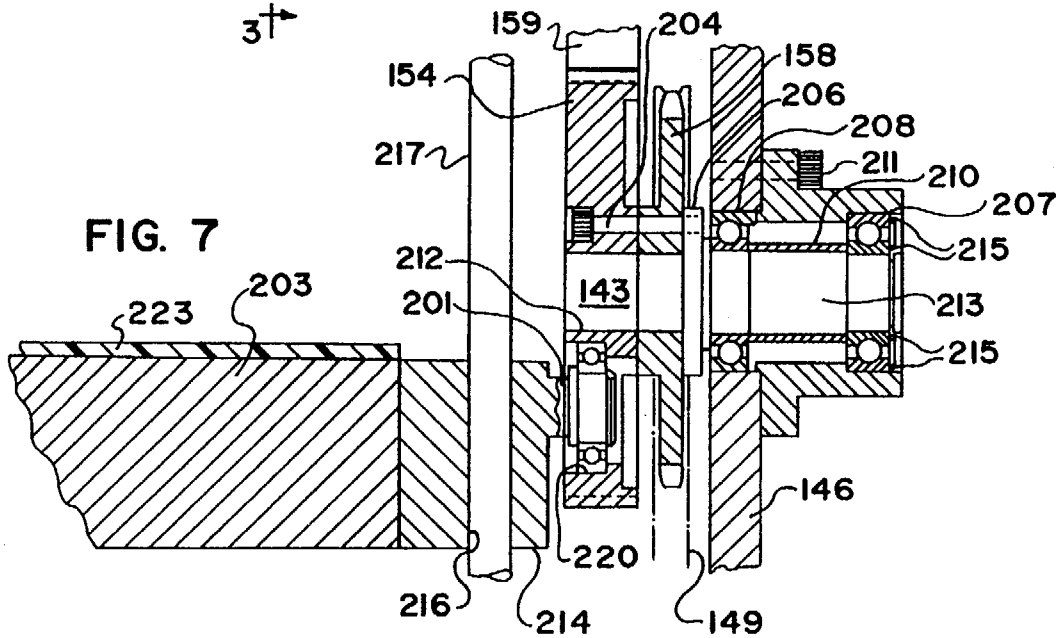
FIG. 7 is an enlarged vertical fragmentary transverse sectional view of the crank arrangement for the lower cross bar, some parts thereof being broken away, and some parts thereof being shown in section.

Each of the gears 154 and 156 is provided with a stub crank shaft 201 and 202 respectively and each such shaft is journaled with respect to its respective associated gear 154 and 156 for rotational movements (by bearing means not detailed). Each crank shaft 201 and 202 is displaced an equal radial distance from the axis of its associated gear. Transversely between the gears 154 and 156 on the opposed respective end portion of each shaft 201 and 202 is suspended the assembly of a lower cross bar 203. Structural details of the combination involving one of the gears 154 are illustratively shown in FIG. 7.

Here, gear 154 and its coaxial sprocket 148 are mounted on shaft 143 in adjacent abutting engagement. A plurality of axially extending Allen head machine bolts 204 (one shown) each engage a common nut 206 that circumferentially extends about shaft 143 in circumferentially spaced relationship to one another and conventional key means (not shown) fix this assembly to shaft 143. Shaft 143 is journaled in a bearing assembly 207 of the rotating sleeve type wherein a sleeve 210 turns with the shaft 143. The bearing assembly 207 is mounted in a mating aperture 208 formed in frame 146. Assembly 207 includes an exterior bearing cap 109 which protects and supports bearing surfaces and which is held against frame 146 by a plurality of Allen machine bolts 211 (one shown) or the like. Snap rings 215 retain assembly 207 in engagement with frame 146.

Crank shaft 201 is journaled by bearing 212 which is located in radially spaced, parallel relationship to the axis 213 of gear 154 and its associated shaft 143. A snap ring 220 retains bearing 214 in association with gear 154.

At each of its opposite ends, the cross bar 203 is provided with a linear bearing 214 (paired). Each bearing 214 is conventionally associated (means not shown) with a different opposite end of cross bar 203 therebetween. Each crank shaft 201, 202 is then conventionally connected (means not shown) to the outside end of a different bearing 214 for purposes of suspending the cross bar 203 between shafts 201 and 202. The bearings 214 each have a bearing channel 216 therein which extends perpendicularly relative to cross bar 203 and also to axis 213 and which is oriented perpendicularly to the upper face 225 of lower cross bar 203. Slidably extended through each channel 216 is a guide rod 217 (paired) for achieving sliding reciprocal movements of each rod 217 relative to each associated channel 216.

Each of the gears 159 and 161 is similarly provided with a spur crank shaft 218 and 219 which is similarly journaled in its respective associated gear 154 and 156 for rotational movements. Each crank shaft 218 and 219 is likewise displaced an equal radial distance from the axis of its associated gear. The gears 159 and 161 are equal in radial size to the gears 154 and 156 and the radial spacing of all crank shafts 201, 202,218 and 219 from the axis of its associated gear is equal.

Transversely between the gears 159 and 161 on the opposed respective end portion of each shaft 218 and 219 is suspended an upper cross bar 221. At each of its opposite respective ends the cross bar 221 is provided with a side projecting integral extension 222 (paired) which is perpendicular to the main body 228 of cross bar 221. At a location adjacent the outside terminus of each extension 222, a different one of each shaft 218 and 219 is connected in opposed relationship relative to the other thereof so that the main body of cross bar 221 extends horizontally. From the outside terminus of each extension 222 extends a guide rod 217, each rod 217 being in spaced, parallel relationship relative to the other. Each rod 217 extends through a different channel 216 of a bearings 214. Thus, when the adjacent gears 154 and 159 and 156 and 161, respectively are engaged, and sprockets 147 and 148 are rotated, each of the upper and lower cross bars 221 and 203 pursues an orbital cylindrical path. Each cross bar 221 and 203 is maintained in a fixed vertical relationship relative to the other by the sliding engagement of the rods 217 with respect to cross bar 203 and its bearings 214.

The upper transversely extending surface of the lower cross bar 203 has mounted thereon a layer 223 of a resilient elastomeric material, such as a rubbery polymer or the like. Depending downwardly from the main body 228 of the upper cross bar 221, and extending generally between the paired extensions 222, is a transversely elongated package end forming seal bar or sealing knife 224.

Figure 6:
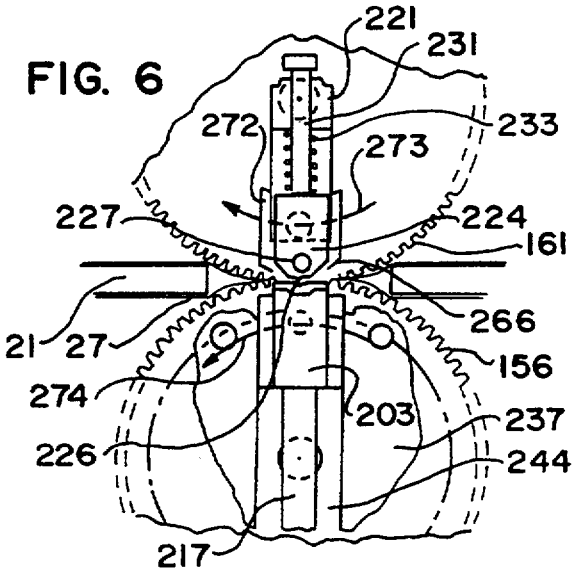
FIG. 6 is an enlarged fragmentary vertical longitudinal sectional view taken in the region VI—VI of FIG. 3, some parts thereof being broken away and some parts thereof being shown in section.

Various configurations and structures for a knife 224 are possible, but a preferred form is generally illustrated in FIG. 6. Here, knife 224 along its bottom has tapered side walls which conveniently and preferably terminate in a relatively dull pointed transversely uniform edge 226. Interiorly, an electric resistance heater 227 is provided in adjacent relationship to edge 226 which is thermostatically controlled so as to provide the capability for achieving and maintaining a preferably substantially uniform heating of edge 226. Seal bar or knife 224 preferably has a generally U-shaped stainless fabricated sheet steel cover 272 over its top and sides (see FIG. 6). This cover 272 acts as a film clamp to hold film 27 on the forward side and on the trailing side of a cross seal (or cut) at the time of sealing and cutting.

In particular, the film clamp extends below (not shown) knife 224 and slides on slide rods 229 and is spring loaded relative thereto so as to yieldingly move upwards at the time of seal and cut. In the center of the clamp 272 is a safety electrical switch (not shown) that is mounted on pin 230 along the vertical center line of cross head 40 and that from a movably closed position opens at the slightest rise of the cover film clamp 272 (see FIG. 9). This switch is by-passed by a timed cam at the instant of sealing and cutting. At any other time in 360° of machine cycle, the machine 20 will stop if the knife 224 or film clamp strike any object. The rotation path of knife 224 is shown by circumferential line 273 and the rotation path of bar 203 is shown by circumferential line 274.

To aid in film 27 management, air can be injected through tube 276 between knife 224 and cover 272 on the forward side of knife 224 adjacent the bottom edge 226 thereof. Outside surface portions of knife 224 are preferably coated with a layer (not shown) of polytetrafluoroethylene or the like to enhance the non-sticking and release capability of the knife 224 to wrapping films, such as those of the heat shrinkable type.

Knife 224 along its upper transversely extending surface is provided with a plurality of transversely spaced, upstanding guide rods, such as side pins 229 and elongated center pin 230, which are slidably received in clearance channels (not shown) formed in the main body 228 of cross bar 221. To maintain the knife 224 in a vertically spaced relationship to main body 228 of cross bar 221, a pair of larger sized (relative to pins 229) guide rods 231 are provided, each one thereof being located adjacent a different opposite end of knife 224, and each rod 231 is terminally threaded and provided with washer equipped nuts 232 for holding these rods 231 in a fixed extended association relative to the main body 228 of cross bar 221. Also, these rods 231 are each provided with a circumferentially located coiled compression spring 233 (paired) which yieldingly bias the knife 224 in an extended configuration relative to main body 228, such as illustratively shown in FIG. 3, for example. Compression springs 233 are also provided about pins 229 for such biasing. Thus, pressure exerted on the edge 226 causes the retraction of knife 224 towards main body 228 of cross bar 221.

As the gear pairs 154/159 and 156/161 revolve, each gear revolution involves a cycle wherein the knife 224 and the lower cross bar 203 are first brought into a position of contacting engagement one with the other, and then those components are moved in respective cylindrical paths into a position of maximum separation therebetween. Actual cutting of film 27 typically and preferably does not occur. Rather, the heat associated with knife 224 is used to locally melt and sever film 27 positioned between knife 224 and bar 203. The contact time between film layers 27 and the registered knife 224 and bar 203 is adjusted so as to be sufficient to achieve the desired combination of sealing and severance (cutting) in any given operational mode. During operation of mechanism 20 when longitudinally wrapped objects 21 are continuously passing between the knife 224 and the cross bar 203, various operational modes for the knife 224 and the cross bar 203 are possible, such as the following examples illustrate:

(1) Shaft 134 is coaxial with shaft 136 and knife 224 is adjusted by nuts 232 so that only a momentary contacting engagement occurs between knife 224 and bar 203 once during each 360° of gear revolution as the gear pairs 154/159 and 156/161 rotate at uniform rpm.

(2) Shaft 134 is coaxial with shaft 136 and knife 224 is adjusted by nuts 232 so that contacting engagement is achieved between knife 224 and bar 203 over a time interval corresponding to an arcuate segment of the 360° travel path of knife 224 and bar 203, sometimes called an overtravel interval (such as shown in FIG. 6 illustratively).

(3) The pause cam subassembly 137 is used so that the gear pairs 154/159 and 156/161 revolve at a slower rate during a time interval when knife 224 is in the immediate vicinity of cross bar 203 and at a faster rate during the remaining time of each side complete gear revolution. Also, the position of knife 224 is adjusted by nuts 232 so that contacting engagement between knife 224 is achieved for a predetermined overtravel interval.

(4) The pause cam subassembly 137 is adjusted so that during each 360° of complete gear revolution at a predetermined number of rpm, the gear pairs 154/159 and 156/161 revolve at a faster rate during a time interval when knife 224 is in the immediate vicinity of cross bar 203 and at a slower rate during the remaining time of each such complete gear revolutions. Also, the position of knife 224 is adjusted by nuts 232 so that a predetermined overtravel interval of contacting engagement is achieved between knife 224 and bar 203.

In machine 20 operation, the velocity of transport of the film 27 can vary depending upon machine settings which are themselves a function of such variables as object 21 size characteristics and film 27 characteristics. The transport velocity of film 27, as is usual in packaging machinery, must be carefully matched to the operating speed and other variables of the cross head sealer and cutter 40. It is a feature of this invention that the drive subsystem 48 permits adjustment and achievement of such speed synchronization in a simple, effective and safe manner.

The synchronization adjustment is achievable in machine 20 by suitable changes in the setting of the pause cam subassembly 137 (by movement of screw member 197 and of shaft 134) and by changing sprocket 91 which affects the linear velocity of the conveyor 38. Relatively coarse changes in velocity are achievable in chain conveyor 22 by changing the engagement of sprocket 63 with the sprockets associated therewith on shafts 66 and 62 (such as sprockets 64/61 or 84/83). The velocity of conveyor 22 can be slightly faster than the velocity of conveyor 38 with the difference being taken up in the region of the winged forming plow 32. Sprocket 91 can be used to synchronize the movement of conveyor 38 with conveyor 43 and also regulates the number of revolutions per minute of shaft 134 (and, therefore, of shaft 141). In place of sprocket 91, other means for speed variation can be used, if desired, such as, for example, a positive variable speed drive (or so called variator), a so-called PIV-type variable drive, or the like, as those skilled in the art will appreciate.

Since it has been observed that, with the shrink wrap films that are currently available commercially, a seal and film cutting operation with cross head 40 is conveniently carried out over time intervals arranged to be of the general type indicated in Example 3 (above), the operational mode of Example 3 (above) is presently preferred. However, as those skilled in the art will appreciate, a wide variety of incrementally adjusted operating capabilities are provided by the present invention for regulating the operational characteristics of knife 224 and bar 203 in effectuating cross sealing and cutting of film 27.

The above described continuous operation by which the knife 224 and the bar 203 are brought together and then separated seemingly suffers from the inherent problem that the conveyor which continuously transports objects 21 through the cross head sealer and cutter 40 needs to be discontinuous in the region where knife 224 and bar 203 are brought together. This problem is seemingly exacerbated by the additional circumstance that the longitudinal region over which the knife 224 and the bar 203 are in a proximate relationship with one another is relatively extended. Over this region, then, a conventional conveyor system with a translating belt arrangement could not extend so that a conventionally unsolvable problem of package support and spatial positioning in the region of cross head sealer and cutter 40 would appear to exist.

However, such problems and others have been solved in the present invention by the provision of a single conveyor 43 which not only is effectively discontinuous in the region of the knife 224 and the bar 203, but also has a longitudinally generally continuously shifting (relative to machine 10) effective discontinuity whose location at any given time corresponds to the longitudinal location of the knife 224 and the bar 203 particularly when they are in their proximate relationship with one another.

As indicated above, the horizontal and return pathways along which the upper surface of conveyor 43 moves is defined by rollers 103 through 110. Of these, rollers 103, 104, 105 and 106, and also idler roller 112, are journaled for rotational movements at stationary sites using fixed portions of the frame assembly 146. However, although rollers 107, 108, 109 and 110 are likewise each journaled for rotational movements, they are mounted to a carriage subassembly that is designated in its entirety by the numeral 235 and that is comprised of a pair of spaced, parallel side plates 236 and 237 (see FIGS. 3 and 5) and also a pair of cross members 238 (not shown in FIG. 3 but see FIG. 5). The base of each plate 236 and 237 is associated with a pair of bearing blocks 239 which are each preferably provided with linear bearings. The bearing blocks 239 that are associated with plate 236 are slidably mounted on a horizontal shaft 241, and the bearing blocks 239 that are associated with plate 237 are slidably mounted on another horizontal shaft 242. Shafts 241 and 242 are in spaced, parallel relationship to each other, and are each associated at their respective opposite ends with adjacent fixed portions of frame 146. Thus, the carriage 235 is reciprocatorily slidable on shafts 241 and 242.

Each side plate 236 and 237 has a vertically oriented slot 243 and 244, respectively, formed therein, and each slot is open at its upper end. The width of each slot 243 and 244 is sufficient to accommodate the width of the lower cross bar 203. The length of the rollers 110, 109, 108 and 107, and also the distance between plates 236 and 237, is such that the plates 236 and 237 extend lower cross bar 203 so that each plate 236 and 237 is adjacent a different respective opposite end of bar 203 (adjacent the bearing blocks 214). As a consequence, when lower cross bar 203 follows its cylindrical orbit as engaged gears 154 and 156 revolve, the cross bar 203 oscillatorily moves upwards and downwards in each of the slots 243 and 244 in non-contacting relationship. Transversely outwardly extending from and mounted to the outside of each plate 236 and 237 is a linear bearing block 268 and 269, respectively. Each of the respective guide rods 217 extends through a different linear bearing of one block 268 and 269. Thus, as the gears 159 and 161 revolve, the guide rods slidably move up and down in the bearing blocks 268 and 269. In addition, the plates 236 and 237 are concurrently moved slidably along the shafts 241 and 242. As a consequence, the carriage 235 oscillates in a left/right side-to-side direction in FIG. 5, and in a direction vertical to the plane of the paper in FIG. 3, by the guidance produced through the association with rods 217.

An apparent discontinuity seemingly exists in conveyor 43 in the region of the lower cross bar 203 as bar 203 moves with the rods 217 because of spacing differences that occur between rollers 106 and 107 and rollers 103 and 110 during operation of machine 20. However, as the distance between the centers of rollers 106 and 107 decreases (see Figs., for example), the distance between the centers of rollers 110 and 103 expands concurrently, and vice versa, during a remaining 180° of 360° of machine operation, so that the overall perimeter of conveyor 43 remains constant, and so no actual discontinuity or problems with conveyor perimeter dimensional change occur. The longitudinal (relative to machine 20) distance across the apparent discontinuity in the region of lower cross bar 203 is minimized so no problem with nonsupport of an object 21 in the region of lower cross bar 203 occurs. The vertical distance between roller 110 and roller 109, and also between roller 107 and roller 108, is such as to be greater than the total vertical distance traveled by lower cross bar 203, so that the conveyor 43 and its components do not interfere with operation of the lower cross bar 203, the knife 224 and their respective associated components.

An object 21, after separating of knife 224 from bar 203, is illustratively shown in FIG. 3. To achieve the capacity for centering the engaged region between knife 224 and lower cross bar 203 relative to objects 21 of a series thereof, the frame assembly 146 of cross head sealer and cutter 40 is comprised of an outer fixed support frame 246 and an interior adjustable support frame 247. Outer frame 246 includes a transverse base support 248, and a pair of spaced, parallel side walls 249 and 251 each of which terminates in an inturned top flange 252 and 253, respectively. A rod 254 and 256 upstands each in spaced parallel relationship relative to the other from an inside edge of each flange 252 and 253.

A pair of fluidic cylinders 257 and 258, each preferably pneumatic, is provided, each one having its cylinder body associated with a different side wall 249 and 251 in the region of the respective flanges 252 and 253 through each of which each cylinder body projects. The piston 264 and 266 of each cylinder 257 and 258 upwardly extends in spaced parallel relationship relative to the other thereof.

All moving and associated components of the cross head sealer and cutter 40 are associated with the interior adjustable support frame 247 which includes the U-configured carriage member 163 and its cross supports 248 to which opposite ends of shafts 241 and 242 are secured, a pair of spaced parallel upper side walls 259 and 261 which are each affixed at their respective lower end portions to a different one of the respective upper side portions of carriage member 163, and a top cross plate 262 which extends transversely over and across the upper edges of the upper side walls 259 and 261. In effect, interior frame 247 is suspended relative to outer frame 246 by plate 262. Mating apertures (not detailed) in plate 262 allow slidable extension of rods 254 and 256 therethrough. Additional guidance and stabilization of interior frame 247 relative to outer frame 246 is provided by transversely outwardly extending ears 263 (paired) affixed to opposite outside faces of each upper side wall 259 and 261. Each ear 263 is provided with an aperture which permits aligned engagement thereof with rods 254 and 256. Linear bearings 264 (paired) are preferably associated with plate 262 for the rods 254 and 256 (and also for ears 263 but not shown).

The end of each piston 264 and 266 abuts the undersurface of plate 262 adjacent a different opposed outside edge thereof. Thus, actuation of cylinders 257 and 258 causes vertical elevation or lowering, as desired, of plate 262 and the entire interior frame with its associated components. Such vertical movements do not disrupt the power transfer arrangements hereinabove described because, as described above in relation to the pause cam subassembly 137, the pivotally interconnected arms 174 and 186 and their associated drive transfer members, simply pivot as such vertical movements occur.

In the shrink film wrapper 20, the flighted infeed conveyor 22 and cross head seal and cut subassembly 40 operate synchronously with respect to each other. Different bag cutoff lengths can be accomplished by changing the translation speed of the vacuumized conveyor 38 and the infeed conveyor 22. For example, to adjust for different bag lengths, the chain idler sprocket 91 can be removed and replaced with a sprocket of different diameter to achieve a desired ratio for a spring detented shaft 73. To register the flighted infeed conveyor 22 to a given product (not shown), the electric infeed clutch 70 is deactivated and the positions of the pins of flights 86 are adjusted so as to achieve a desired spacing for flights 86. For bag lengths greater than, for example, about 12 inches, every other flight is removed.

Since the bottom surface of each object 21 is always resting on the same plane in wrapper 20, an increase in product height requires an adjustment of the vertical position of the cross head seal subassembly 40 at which sealing occurs to achieve, for example, as preferred, a cross seal approximately half way up the height of the product. Such an adjustment of package cross seal height is accomplish by raising the cross head 40 interior frame 247, which is built as a modular system relative to the conveyors 22 and 38, with the use of cylinders 258 and 257 that are conveniently activated by a hand operated pump (not shown) or the like. The entire cross head subassembly 40 associated with interior frame 247 slides freely up and down on four externally mounted rods 254.

Longitudinally longer objects 21 require higher film velocities than shorter objects 21, provided the number of wrapped packages produced per unit of time is equal. Since the rotational velocity of the knife 224 and the lower cross bar 203 in cross head 40 is directly proportional to the machine feed speed as set, for example, by translation speed of conveyor 22 and feed speed for film 27 in stand 29 the pause cam subassembly 137 is used to vary the rotational velocity of the knife 224 and bar 203 so that, at the moment of seal, such velocity matches the translational speed of the film on conveyor 43 as delivered by the conveyor 38. The eccentricity of this linkage is manually adjustable by use of a hand wheel (not shown) associated with screw member 197. If the respective velocities do not match, then the objects 21 in seal head 40 will bunch up due to mismatched speeds.

The cross head subassembly 40 includes a rotating knife 224 and a synchronously rotating lower bar 203. Each has a rotating pivot joint at each end thereof that is mounted eccentrically to rotating gears. The gears are cantilevered on outboard bearing housings 2 mounted to frame walls 259 and are driven by chains 149 and 151 that are timed to the flighted infeed conveyor 22. The knife 224 and the lower cross bar 203 rotate with an orbital motion and are held parallel relative to each other by a set of slide bearings 214 that are associated with rods 217 that are preferably comprised of hardened and ground steel. The sealing surfaces of knife 224 and bar 203 come into contacting engagement with one another as platens, thereby sealing the trailing end of one package and the leading end of the next one while concurrently cutting the two apart all in the same orbital motion.

The overwrapped packages are successively translated through the cross head subassembly 40 on conveyor 43 while utilizing the rotary motion of the cross head subassembly 40 and coordinated oscillating shifting of upper surface portions of the conveyor 43. The conveyor 43 is thus kept evenly spaced between the rotating knife 224 and bar 203. This oscillating conveyor 43 is powered by the drive subsystem 48 and always stays in the same top plane as the top of the vacuumized conveyor 38.

Shrink type wrapping film 27 is loaded in roll form onto an unwind stand 29. The unwind stand 29 has lateral roll adjustment, a set of oscillating dancer rolls 24, and a tension brake. As the film 27 moves and advances, it preferably passes over a roll with perforators. The film 27 is passed over a tunnel style winged forming plow 32 which wraps the film 27 around each object 21 as it passes through the plow 32 creating a film tube with overlapping edges. The longitudinal overlays of film can be sealed between the plow 32 and the succeeding belt 38.

Each completed overwrapped and sealed package is conveyed from cross head 40 to tunnel 37 to shrink the overwrapped film tightly around the package.

When the cross head mechanism 40 becomes jammed with film 27 and objects 21, the relative movement of the upper cross bar 221 and/or knife 224 trips a microswitch (not shown) which then activates an emergency stop. A selector switch is then moved from a machine forward position to a machine reverse position by the operator. Also, a so-called "inch button" switch is pushed by the operator and held for a time sufficient to allow the resulting slow reverse motion of conveyors 22, 38 and 43 and of the seal head gears 149, 151, 159 and 161 to disengage the seal heads relative to objects 21 and film 27. Slow reverse is accomplished by a direct current (D.C.) drive motor 50. A D.C. motor speed control 267 (see FIG. 9) is actuated and placed into a predetermined reverse/slow speed mode by an operator controlled selector switch (not shown) and "inch button" switch (not shown). Once there is sufficient room to clear the jam, the inch button is released, the machine stops, and the jam is manually cleared. The entire machine remains in synchronous time during the jam clearing activity since, for example, during such activity, the infeed flight conveyor 22 is not declutched during the operation. Thereafter, the selector switch is switched by the operator to the (normal) forward operating position. Then, a reset button is operator activated, and the machine can be activated by the operator to begin packaging again.

Although the invention has been described with reference to particular embodiments, it should be understood that many variations and modifications will be apparent to those skilled in the art. The scope of this invention is not limited by the foregoing specific embodiments.

What is claimed is:

1. Apparatus for continuously wrapping articles comprising:

(a) conveyor means for sequentially translating a plurality of articles along a generally horizontal path with an interspatial region between longitudinally adjacent successive articles;

(b) a first station along said path having means for continuously forming a longitudinally extending tubular overwrap circumferentially about said sequential articles and said interspatial regions from a continuous film as said articles translate through said station and including means for adhering together resulting longitudinally extending overlapping film side edge portions of said overwrap; and (c) a second station along said path having means for cross sealing and separating said tubular overwrap in each said interspatial region, said sealing and separating means comprising a combination of a continuously rotating cross sealing knife means, a continuously rotating cross sealing bar means which register with each other once each 360° of rotation of each at a cross location in each said interspatial region, a pause cam means for varying a rotational speed during each 360° of revolution thereof so that the time of registration between said knife means and said bar means is greater that the time of registration achievable when said rotational speed is substantially constant, said pause cam means having an eccentric drive assembly operatively connected to both a first pair of pivotably joined pivoting arms and a second pair of pivotably joined pivoting arms, and said sealing and separating means further including drive and synchronization means, so that each successive said article is separately packaged with said film.

2. The apparatus of claim 1 which includes a third station along said path having means for subjecting each said successive separately packaged article to predetermined elevated temperatures so that said film is heat shrunk about each said article.

3. The apparatus of claim 1 wherein said means for cross sealing and separating comprises in combination:

(a) first and second respective pairs of gears, each respective member gear of each said pairs being in transversely spaced parallel relationship relative to the other thereof, and the respective member gears of said second pair each being in geared association with a different one of said first gear pair member, and said pairs being in functional association with said pause cam means;

(b) elongated knife means, including electric heating means therefor;

(c) bar means approximating the length of said knife means; and

4. The apparatus of claim 3 further including:

(a) power means for rotating said first and said second pairs of gears, and for translating said conveyor means; and (b) synchronization means for coordinating rotational movements of said gear pairs with translational movements of said conveyor means so that the progression rate of said articles is such that said registration takes place in said interspatial region between each succeeding pair of said so overwrapped articles.

5. The apparatus of claim 3 which further includes generally vertical guidance shaft means extending from one and slidably interconnecting with the other of said knife means and said bar means, including linear bearing means therefor, so that said bar means and said knife means each maintain a predetermined orientation relative to the other thereof.

6. The apparatus of claim 3 wherein at least one of said knife means and said bar means includes spring biasing means for yieldingly urging said knife means into said registration with said bar means so that said registration is maintainable over an arcuate path of travel therebetween.

7. The apparatus of claim 1 wherein said means for continuous overwrap forming comprises in combination:

a) a film supply train including:
film supply roll supporting means,
film adjustable centering means,
film roll advancing means, including power therefor;

b) film winged forming plow means for continuously circumferentially and longitudinally overwrapping said articles as so sequentially translated into said first station by said conveyor means; and c) vacuum generating and maintaining means operating through surface portions of said conveyor means after said first station, for holding and drawing the advancing sequence of said so overwrapped articles issuing from said winged forming plow means.

8. The apparatus of claim 7 wherein said film supply train further includes film perforating means.

9. The apparatus of claim 1 which further includes detector means for sensing a desired predetermined spatial location for each one of said overwrapped articles on said conveyor means before said second station is reached.

10. The apparatus of claim 9 which further includes control means in functional association with said detector means which is adapted to stop operation of said apparatus if said detector means fails to so sense an overwrapped article at each said predetermined location.

11. The apparatus of claim 1 which further includes means for controllably reversing the normal forward operation of said apparatus when a jam occurs in said second station.

(d) crank means for suspending each one of said knife means and said bar means between a different one of said gear pairs so that the interrelationship therebetween is such that, during each 360° of revolution of said first and said second gear pairs, said knife means and said bar means come into registration with each other across said predetermined cross location that extends transversely between said gears.

12. A method for continuously wrapping articles comprising:

(a) sequentially continuously translating a series of like articles along a horizontal path with an interspatial region between longitudinally adjacent successive articles;

(b) at a first station along said path, continuously forming a longitudinally extending tubular overwrap about said articles from a continuous film as said first articles translate through said station and then adhering together resulting longitudinally extending opposing side edge overlapping portions of said tubular film overwrap; and (c) at a second station along said path, continuously rotating each of a heated cross sealing knife means and a cross bar means so that said knife means and said cross bar means register with each other once during 360° of revolution of each at a location across said path, and varying a rotational speed during each 360° of revolution thereof so that the time of registration between said knife means and said bar means is greater than the time of registration achievable when said rotational speed is substantially constant, the rate of said rotation and the rate of said translating being such that said registration occurs within the interspatial region between succeeding so overwrapped articles so that each succeeding so overwrapped article is cross sealed and separated as a wrapped package in said station.

13. The method of claim 12 wherein said film is heat shrinkable and wherein said so separately wrapped articles further continue translating along said path and pass through a heated zone wherein said film is heat shrunk about each said packaged article.

14. Crosshead sealing and cutting apparatus for use in a continuously operating wrapping machine wherein articles being wrapped are first sequentially and longitudinally overwrapped with a continuous film, said cross head sealing and cutting apparatus comprising:

(a) first and second respective pairs of equally sized gears, each respective member gear of each of said pairs being in transversely spaced, parallel relationship relative to the other thereof, and the respective member gears of said second pair are each in geared association with a different one of said first gear pair members;

(b) an elongated knife means, including electric heating means therefor;

(c) bar means approximating the length of said knife means;

(d) crank means for suspending each one of said knife means and said bar means between a different one of said gear pairs so that the interrelationship therebetween is such that, during each 360° of revolution, said knife means and said bar means come into registration with each other across said predetermined spatial location that extends transversal between said gears.

(e) conveyor means for continuously translating sequentially each of said overwrapped articles through said apparatus in a direction generally perpendicular to said registration location;

(f) power means for rotating said first and second pairs of gears and for translating said conveyor means;

(g) synchronization means for coordinating rotational movements of said conveyor means with translational speed of said conveyor means so that said registration occurs in an interspatial region between each succeeding pair of said so overwrapped articles; and (h) pause cam means for varying a rotational speed during each 360° of revolution thereof so that the time of registration between said knife means and said bar means is greater that the time of registration achievable when said rotational speed is substantially constant.

15. The apparatus of claim 1, which further includes means for synchronization adjustment of said pause cam means.

* * * * *